United States Patent [19]

Balzau et al.

[11] 4,221,509

[45] Sep. 9, 1980

[54] PNEUMATIC DISCHARGE OF FINE MATERIAL FROM A CONTAINER

[75] Inventors: Gerhard Balzau, Beckum; Günter Kompa, Lippstadt; Manfred Steinmann, Beckum; Klaus Bode, Rheda-Wiedenbrück, all of Fed. Rep. of Germany

[73] Assignee: Polysius AG, Beckum, Fed. Rep. of Germany

[21] Appl. No.: 946,585

[22] Filed: Sep. 28, 1978

[30] Foreign Application Priority Data

Oct. 5, 1977 [DE] Fed. Rep. of Germany ..... 2744853

[51] Int. Cl.[2] ..... B65G 53/50; B65G 69/06

[52] U.S. Cl. ..... 406/91; 222/195

[58] Field of Search ..... 222/56, 195, 630; 406/23, 24, 90, 91, 137, 138, 146

[56] References Cited

U.S. PATENT DOCUMENTS

| | | | |
|---|---|---|---|
| 1,994,899 | 3/1935 | Schaub | 406/23 X |
| 2,192,287 | 3/1940 | Goebels | 406/138 |
| 3,104,030 | 9/1963 | Howlett | 222/56 X |
| 3,121,593 | 2/1964 | McIlvaine | 222/195 X |
| 3,188,144 | 6/1965 | Gmur et al. | 406/23 |
| 3,514,158 | 5/1970 | Stahler et al. | 406/91 |
| 3,989,310 | 11/1976 | Aller | 222/195 X |
| 4,082,205 | 4/1978 | Kluger et al. | 406/90 |

FOREIGN PATENT DOCUMENTS

| | | | |
|---|---|---|---|
| 2400996 | 7/1975 | Fed. Rep. of Germany | 222/195 |

*Primary Examiner*—F. J. Bartuska

*Attorney, Agent, or Firm*—Learman & McCulloch

[57] ABSTRACT

A container bottom for the pneumatic discharge of fine material from a container comprises a plurality of conveying channels extending radially to a central material discharge zone of the bottom, the bottom of the central material discharge zone being disposed lower than the bottom of the conveying channels to obtain a uniform passage of the material from the conveying channels to the central material discharge zone.

13 Claims, 2 Drawing Figures

PNEUMATIC DISCHARGE OF FINE MATERIAL FROM A CONTAINER

Figure 1:
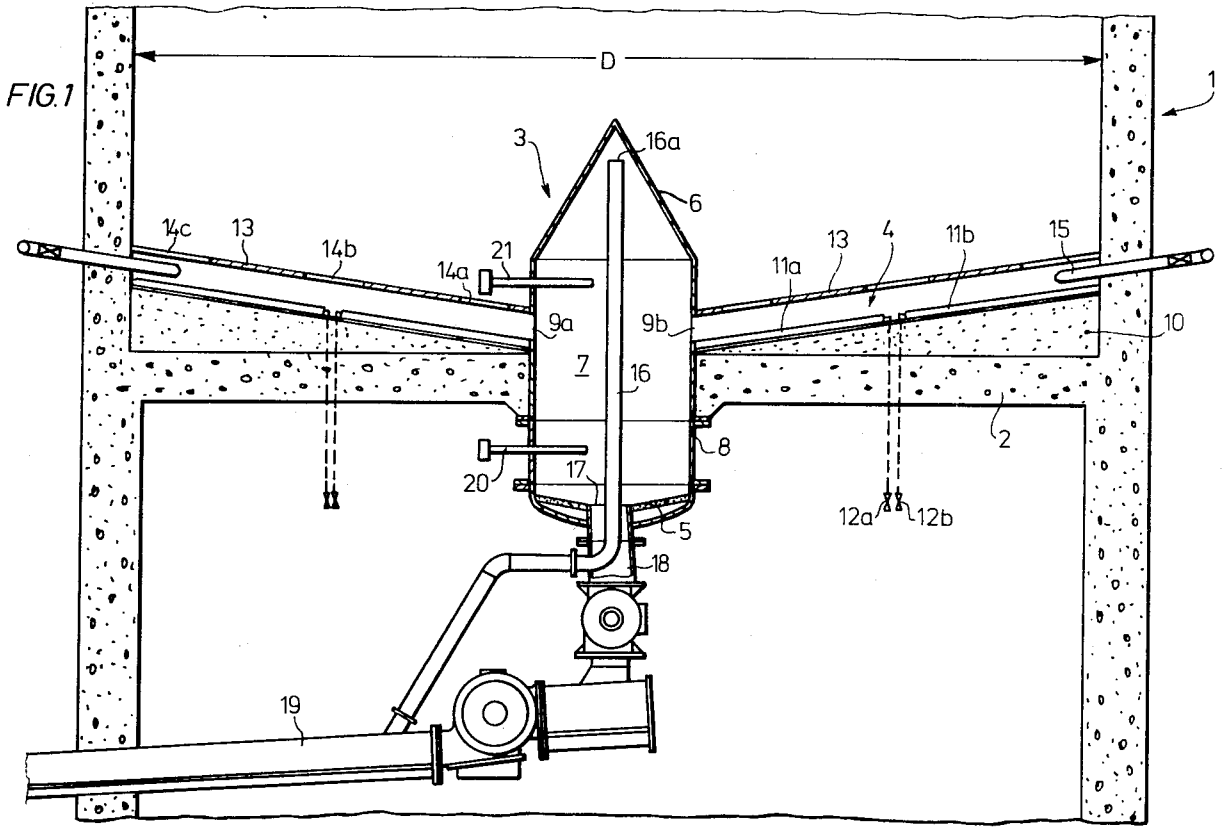

The invention relates to a container bottom for the pneumatic discharge of fine material and having a central material discharge zone which comprises a continuously aerated bottom having at least one material discharge opening and a roof-like cover spaced above the bottom, and further comprising a plurality of conveying channels which extend radially to the central material discharge zone. The channels are at least periodically aerated, each has a bottom inclined towards the material discharge zone and covered at the top by covers provided with material passage openings.

The invention further relates to a method for discharging material from a container having such a bottom.

A container bottom generally of the kind to which the invention relates is known; see, for example, U.S. Pat. No. 4,082,205. It is distinguished from other known constructions by a substantially uniform lowering of the material column over the entire cross-section.

In the further development work on the known container bottom it has now been found desirable to improve further the entry of the material into the conveying channels and the passage of the material from such channels to the central discharge chamber so that even materials which are particularly difficult to convey can be withdrawn uniformly. The objective of the invention is thus to provide a container bottom of the type mentioned in which this requirement is met.

This objective is achieved according to the invention in that the bottom of the central material discharge zone is disposed at a level lower than that of the bottom of the conveying channels.

Whereas in the aforementioned known construction the bottom of the central material discharge zone is disposed substantially at the level of the bottom of the conveying channels (at the lowermost inner point thereof), in the construction according to the invention the bottom of the central discharge zone is substantially lower. Extensive tests have shown that in this manner the material supplied from channels can flow without difficulty into the central discharge chamber defined by the bottom and roof-like cover so that blockages in the region of the transition from the channels to the central discharge zone are avoided. The uniform flowing away of the material thus ensured at the inner channel end effects in turn that the material passes into the conveying channels over the entire channel length through the passage openings in the covers and not only at preferred openings lying further towards the inside. The lower disposed bottom of the central discharge zone according to the invention thus provides in the discharge zone the space necessary for the emerging material (taking into account certain fluctuations of the amount of material running out) without impairing the uniform and trouble-free material supply through the conveying channels.

According to a further development of the invention a level metering means is provided in the discharge chamber of the central discharge zone defined by the bottom and the roof-like closure, the aerating of the channels being controlled in dependence upon the signal of such level measuring means in such manner that the aerating of the channels is reduced or discontinued or reaching an upper level of the discharge chamber, but is increased or switched on upon reaching a lower level of the chamber.

Figure 2:
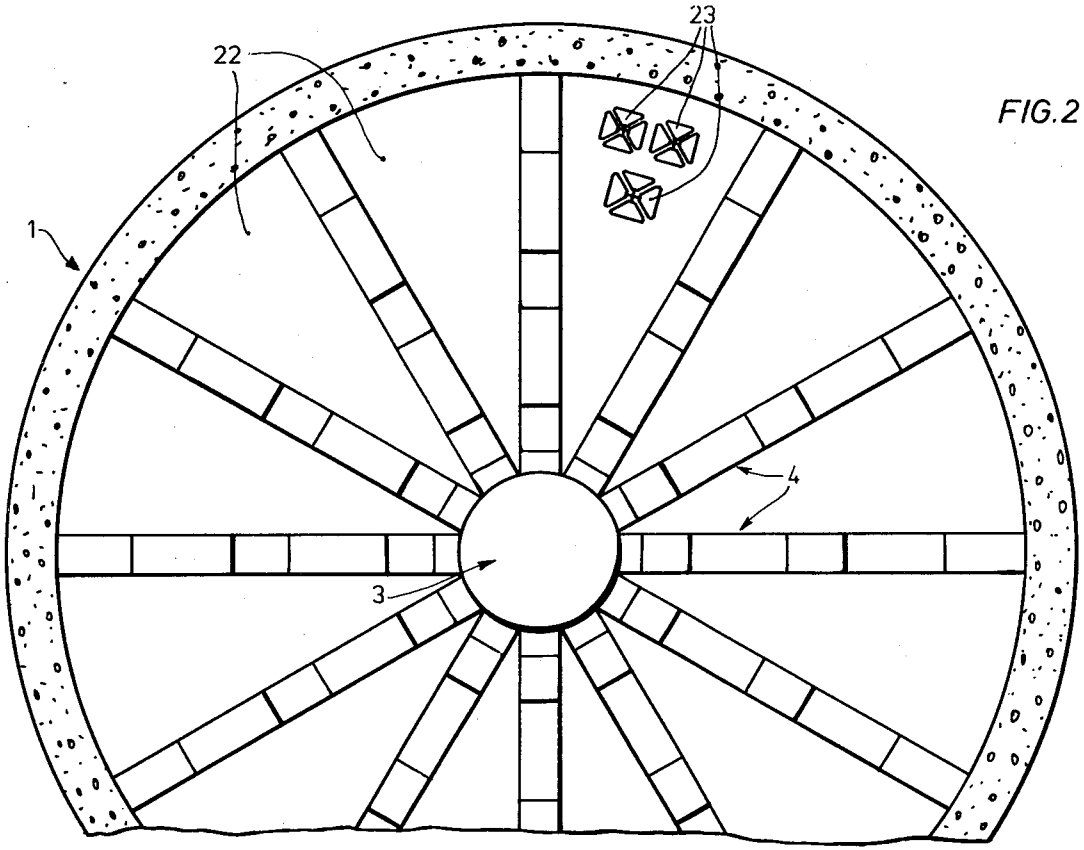

These and numerous other developments of the invention are the subject of the subsidiary claims and will be explained in detail in conjunction with the description of an embodiment illustrated in the accompanying drawings, in which:

FIG. 1 is a vertical section through one embodiment of the container bottom according to the invention; and FIG. 2 is a horizontal section through the container illustrating the bottom in plan.

In the drawings the bottom of a cylindrical, through mixing silo 1 (not illustrated in detail) is shown. This bottom comprises a concrete floor 2 with a central discharge zone 3 and a plurality of conveying channels 4 extending radially to the central material discharge zone 3.

The central discharge zone 3 comprises a porous bottom 5 that is continuously aerated in a known manner, and a roof-like, concial closure 6. The discharge chamber 7 of the central discharge zone 3 thus formed is laterally limited by a housing 8 which includes openings (e.g., *9a, 9b*) for the entry of the material supplied from the channels 4.

The channels 4 are arranged in uniform peripheral distribution in slightly inclined position (sloping from the outside to the inside) and are supported on webs 10. The individual conveying channels 4 are provided in the region of the channel bottom with aerating means *11a, 11b*, the radially inner aerating means *11a* and the radially outer aerating means *11b* being adapted for separate aeration (connections *12a, 12b*).

The channels 4 are covered at the top by covers 13 which are provided with material passage openings *14a, 14b* and *14c*. In the embodiment illustrated the size of these passage openings *14a–14c* increases somewhat from the inside to the outside.

The covers 13 of the channels 4 extend substantially parallel to the bottom of the associated channels. In the radial direction the conveying channels 4 extend to an outer diameter corresponding to the maximum internal diameter D of the silo 1.

A ventilating lance 15 is disposed in the outer region of the conveying channels 4.

In the central discharge chamber 7 of the central discharge zone 3 a vent tube 16 is provided whose opening *16a* extends to just beneath the tip of the conical cover 6. The vent tube is disposed vertically in the chamber 7 and is led outwardly laterally via the discharge pipe 18 adjoining the opening 17 and projects into the pneumatic conveying channel 19 which further conveys the material discharged from the silo 1. Between the discharge pipe 18 and the channel 19 further conveying and blocking means of known construction are provided.

Provided in the discharge chamber 7 is a level measuring means of known construction which includes a lower and an upper level sensor 20 and 21 respectively. The lower level sensor 20 is disposed relatively closely above the bottom 5 of the chamber 7 whilst the upper level sensor 21 lies relatively closely above the inlet openings *9a, 9b* and adequately beneath the opening *16a* of the vent tube 16.

The bottom of the central discharge zone 3 lies, according to the invention, at a level substantially lower than that of the bottom of the conveying channels 4. The level difference is (in the region of the opening of the channels 4 into the chamber 7) between 10% and 50% and preferably between 20% and 40%, of the container radius. At the least the level difference is about 0.5m and at the most about 4m.

The sector-like zones 22 of the container bottom between and defined by the individual channels 4 have substantially the same inclination and height as the covers 13 of the adjacent channels 4. These sector-like zones 22 may include aerating means which are indicated at 23 in FIG. 2 for one sector-like zone.

It is possible for the sector-like zones 22 of the container bottom disposed between the individual channels 4 to form two roof-like inclined surfaces provided with aerating means having a ridge edge extending radially towards the central discharge zone.

In operation of the silo, the aeration of the conveying channels 4 is preferably effected in dependence upon the signal of the level measuring means (sensors 20,21) in such manner that the aeration of the channels is discontinued when the material level in the chamber 7 has reached the level of the upper sensor 21, whilst the aeration of the channels is switched on or increased when the material level has dropped to the level of the lower sensor 20. That is, the rate of aeration is inverse to the level of material in the chamber 7. Since this prevents overfilling of the central discharge chamber 7 a uniform good material supply from the channels to the chamber 7 is ensured.

The channels 4 may be aerated in known manner either simultaneously or, as is generally preferable, in periodic succession about the circumference of the silo. In the latter case either only one channel, or alternatively a plurality of channels, for example two diametrically opposed channels may be aerated simultaneously.

The ventilating lances are used in particular when especially poorly flowing materials are to be supplied by the channels 4 to the chamber 7. These lances 15 may be driven pulse-like in such a manner that the air discharge speed at the lance opening is between 100 and 400 m/s, preferably between 200 and 300 m/s. For this purpose an air pressure of about 0.5–1.5 in excess of barometric pressure is necessary in front of the lance. However, due to the brief pulse-like aeration the overall requirement is very low.

To promote the material movement in the radially outer regions of the channels 4 it may be advantageous to supply the radially outer aeration means **11*b* with somewhat more air than the radially inner aeration means 11*a***.

What is claimed is:

1. In a container adapted to contain fine material for pneumatic discharge and having a bottom member provided with a centrally located opening; a housing occupying said opening and forming an aeratable chamber; a plurality of aeratable conveying channels overlying said bottom member in communication with and radiating outwardly from said chamber, each of said channels having a porous base inclined upwardly and outwardly from said chamber; a cover member overlying each of said channels and having openings therein through which material may pass into such channel; and means for aerating said chamber and said channels; the improvement wherein said housing extends above and below said bottom member and has a closure at its upper end and a porous bottom provided with a discharge opening at its lower end, said housing closure being located at a level above that of said container bottom member and said housing bottom being located at a level below that of the base of each of said channels.

2. A construction according to claim 1 wherein the bottom of said chamber occupies a level lower than that of said bases at their juncture with said chamber corresponding to between 10% and 50% of the radius of said container.

3. A construction according to claim 1 wherein the bottom of said chamber occupies a level lower than that of said bases at their juncture with said chamber corresponding to between 30% and 40% of the radius of said container.

4. A construction according to claim 1 wherein the bottom of said chamber is between 0.5 m and 4 m below the bottom of said bases.

5. A construction according to claim 1 wherein said cover of said chamber is conical.

6. A construction according to claim 1 wherein each of said cover members is substantially parallel to the base of the associated channel.

7. A construction according to claim 1 wherein the outer ends of said channels substantially coincide with the maximum internal diameter of said container.

8. A construction according to claim 1 including ventilating lance means communicating with each of said channels adjacent its outer end.

9. A construction according to claim 1 including vent means in said chamber having an opening at a level above the level of said channels.

10. A construction according to claim 9 including a discharge pipe in communication with said discharge opening and wherein said vent means extends into and laterally through said pipe.

11. A construction according to claim 1 wherein said channels define between them sector-shaped zones having upper surfaces which are flat and inclined at the inclination of said channels.

12. A construction according to claim 11 including means for aerating said sector-shaped zones.

13. A construction according to claim 1 wherein the openings in said covers increase in size in a direction radially outwardly of said channels.

* * * * *